US007401540B1

(12) United States Patent
Kocher

(10) Patent No.: US 7,401,540 B1
(45) Date of Patent: Jul. 22, 2008

(54) HIGHLY SURVIVABLE URBAN UTILITY VEHICLE (HSUUV)

(76) Inventor: Robert William Kocher, 4828 3rd St. North, Arlington, VA (US) 22203

( * ) Notice: Subject to any disclaimer, the term of this patent is extended or adjusted under 35 U.S.C. 154(b) by 0 days.

(21) Appl. No.: 11/507,089

(22) Filed: Aug. 21, 2006

(51) Int. Cl.
*F41H 7/02* (2006.01)
*F41H 5/00* (2006.01)

(52) U.S. Cl. ..... 89/36.08; 89/36.09; 89/36.02; 89/36.07

(58) Field of Classification Search ..... 89/36.08, 89/36.09, 36.02, 36.06–36.07
See application file for complete search history.

(56) References Cited

U.S. PATENT DOCUMENTS 4,869,152 A * 9/1989 Marlow et al. ..... 89/36.17
5,637,824 A * 6/1997 Benyami ..... 89/36.17
6,302,010 B1 * 10/2001 Holler ..... 89/36.08
6,327,954 B1 * 12/2001 Medlin ..... 89/36.08
6,658,984 B2 * 12/2003 Zonak ..... 89/36.08
7,225,717 B2 * 6/2007 Williams ..... 89/36.08
7,228,927 B2 * 6/2007 Hass et al. ..... 180/65.2
2006/0243126 A1 * 11/2006 Tyler ..... 89/36.01
2007/0186762 A1 * 8/2007 Dehart et al. ..... 89/36.09
2007/0234896 A1 * 10/2007 Joynt ..... 89/36.09

* cited by examiner

*Primary Examiner*—Victor Batson
*Assistant Examiner*—Michael D David

(57) ABSTRACT

The Highly Survivable Urban Utility Vehicle (HSUUV) redistributes armor in a unique way on a truck type wheeled vehicle so as to defeat Improvised Explosive Devices (IED) to include armor piercing weapons. In so doing, this approach adds significant amounts of armor where it is needed the most, and does so without a significant net weight penalty. This approach of using vehicles capable of carrying heavy side armor was previously not attempted with wheeled vehicles, now provides crew compartments with levels of protection never previously achieved on wheeled vehicles. Using the HSUUV system approach, soldiers can safely and quickly enter areas with an unprecedented amount of survivability and flexibility, allowing for better strategic force protection and tactical operations.

3 Claims, 4 Drawing Sheets

HIGHLY SURVIVABLE URBAN UTILITY VEHICLE (HSUUV)

CROSS-REFERENCE TO RELATED APPLICATIONS

Provisional Patent Application: 60/708,771; Filed Aug. 17, 2005

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION (1) Field of the Invention

This invention relates to the armoring of wheeled vehicles to better protect the vehicle's occupants from various types of threats and attacks.

(2) Description of Related Art

A central problem in the field of military vehicles is the difficulty in armoring. Effective armoring inherently consumes much of a vehicle's load carrying capacity, making for decreased mobility, decreased vehicle life, and increased cost. Current art, such as HMMWVs (High-Mobility, Multi-Purpose Wheeled Vehicles modified with armor kits or armored HMMWVs, essentially creates a box of armor surrounding the occupants of the vehicle, distributing the armor evenly around the exterior of the vehicle. While the occupants are evenly protected from attack from all angles, the level of this protection is relatively low. Current art is particularly unable to defeat roadside improvised explosive devices (IEDs), other explosive munitions such as rocket propelled grenades (RPGs), and armor piercing rounds. This failure results in the deaths of many US soldiers as well as tactical difficulties. Not only is current art relatively ineffective at protecting the occupants of the vehicle, but these vehicles are highly recognizable to enemy forces, often very slow, and are very costly.

BRIEF SUMMARY OF THE INVENTION

The object of the Highly Survivable Urban Utility Vehicle (HSUUV) is to provide soldiers with a vehicle that is effective at protecting them from IEDs, explosive munitions and armor piercing rounds. One major advantage of the HSUUV is the speed and mobility of the vehicle, due to its concentration of innovative armor. Another advantage is its relatively low cost, which will allow for a large deployment of these vehicles.

The HSUUV (Highly Survivable Urban Utility Vehicle) is a truly innovative approach to solving high levels of ballistic threat protection problems, and other applications that require relatively fast, and inconspicuous armored vehicles. Through the use of an innovative armor system and commercial vehicles, such as flat-bed trucks, the HSUUV offers a novel solution to the problem of having an armored vehicle that is both highly mobile and heavily armored.

The HSUUV consists of a commercial vehicle, heavily modified to protect the occupants, but modified in a very novel way. Instead of evenly protecting the interior of the vehicle with relatively thin armor or lower protection levels all around the cab of the vehicle, the HSUUV replaces the doors of a vehicle such as a commercial vehicle with extremely thick side armor. Instead of doors, there is an entrance large enough to fit a soldier with gear either in the rear of the cab, the top, or both. The front and rear of the HSUUV can be armored as well, but much less so, while the bottom can also be fitted with limited protection as well with an under armor pan. The main-heavy armor is specifically designed to protect the driver and passengers from the most likely attack in the intended conditions of use, that is, from a side attack, such as an ambush as the vehicle speeds by. In these conditions, the HSUUV could withstand being attacked by significantly higher threats that would normally destroy conventional vehicles; and, due to its relatively low weight, it could quickly get away from the threat. Instead of trading heavy armoring for load carrying capacity and speed, the HSUUV reaches a compromise of heavy armoring only where it is necessary, which allows it to be both well protected and highly mobile.

As the doors on the HSUUV have been replaced with heavy armor, there is either an entrance in the rear of the cab or through the top, or both. This entrance is large enough for a soldier with gear to enter.

ITEMS

Item 1 is the front of the HSUUV.

Item 2 is the special HSUUV side armor.

Item 3 is a reinforced windshield.

Item 4 is a rear entry to the HSUUV.

Item 5 is the HSUUV under-armor.

Item 6 is Kevlar Liner or other liner.

Item 7 is 7039 Aluminum or other light metal aluminum armor.

Item 8 is Rolled Homogeneous Armor Steel (RHA) or similar armor.

Item 9 is an Explosive Reactive Armor (ERA).

Item 10 is firing zone A, where the most fire or greatest threat is anticipated.

Item 11 is firing zone B, the front of the vehicle.

Item 12 is firing zone C, the back of the vehicle.

Item 13 is firing zone D, the bottom of the vehicle.

DETAILED DESCRIPTION DETAILED DESCRIPTION OF THE INVENTION

Figure 1:
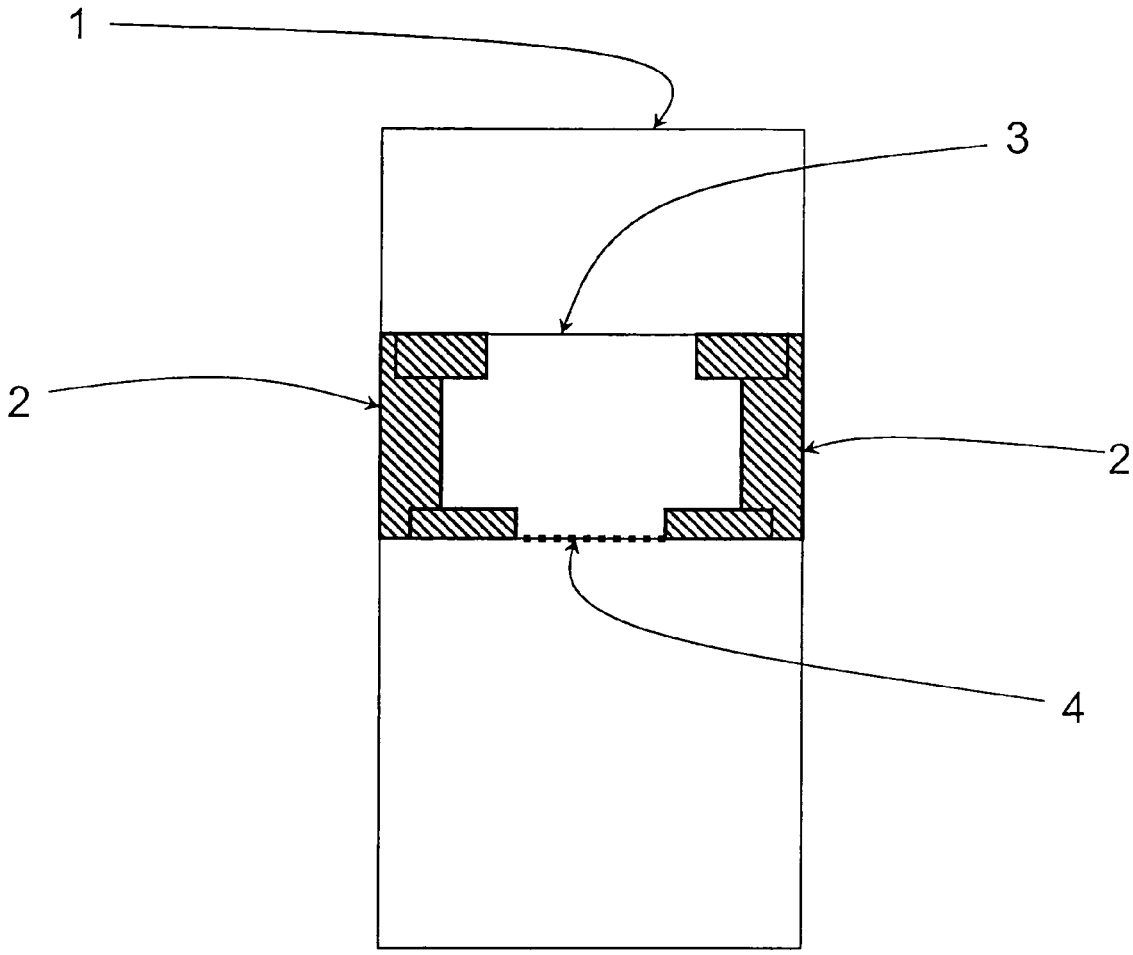
FIG. 1 shows a top down view of the HSUUV

Description—FIG. 1

FIG. 1 depicts a top down view of the HSUUV, with a reinforced windshield 3 on the front 1. On the sides, extending to cover the occupants is the specially designed HSUUV side armor 2. In the rear of the cab is an entrance 4.

Figure 2:
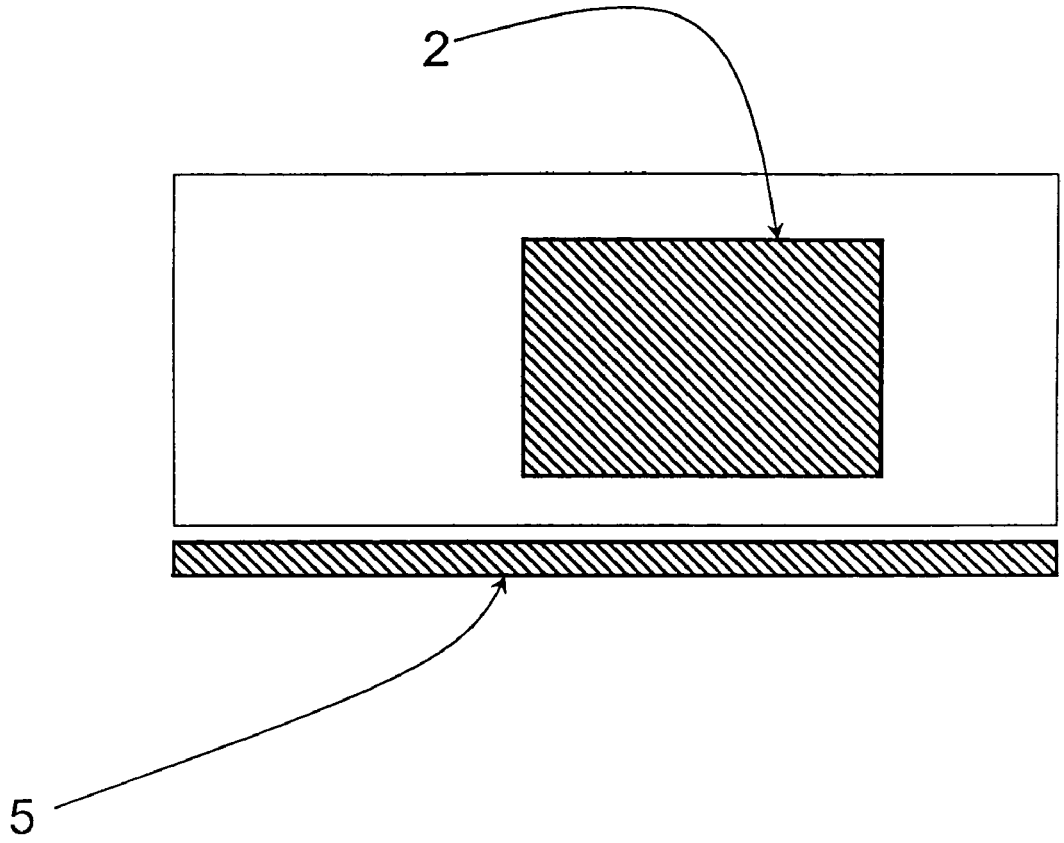
FIG. 2 shows a side view of the HSUUV

Description—FIG. 2

FIG. 2 depicts a side view of the HSUUV. There is side armor 2 protecting the occupants, as well as under-armor 5 protecting the bottom of the vehicle.

Figure 3:
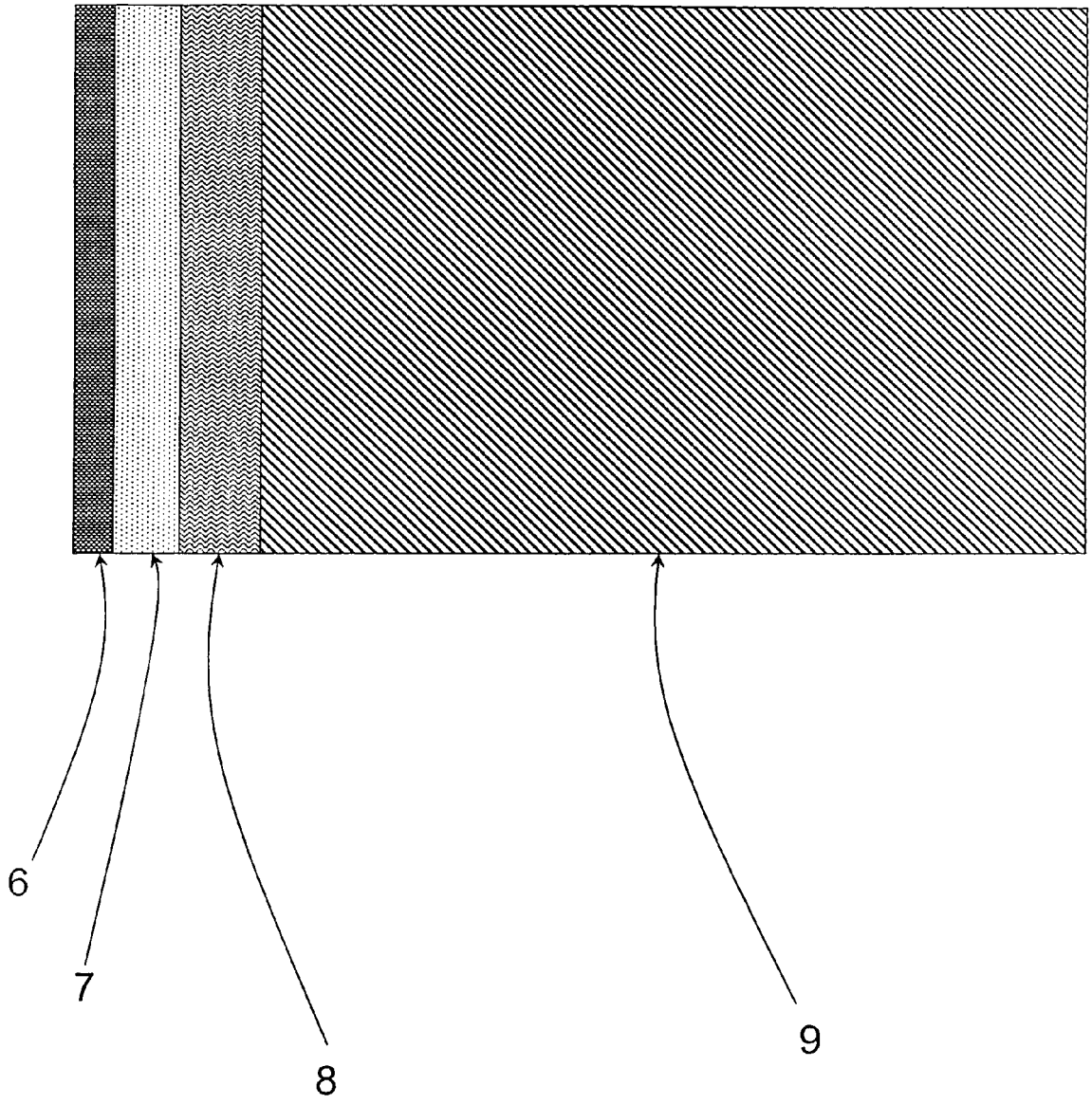
FIG. 3 shows an example of HSUUV armor

Description—FIG. 3

FIG. 3 depicts a cross section of an example of the preferred embodiment of an HSUUV armor. This example consists of a ¾ inch Kevlar Liner 6, a one inch layer of 7039 aluminum 7, a 1¼ inch RHA layer 8 and a 12.2 inch layer of ERA 9. Other embodiments of this heavy armor are also possible.

Figure 4:
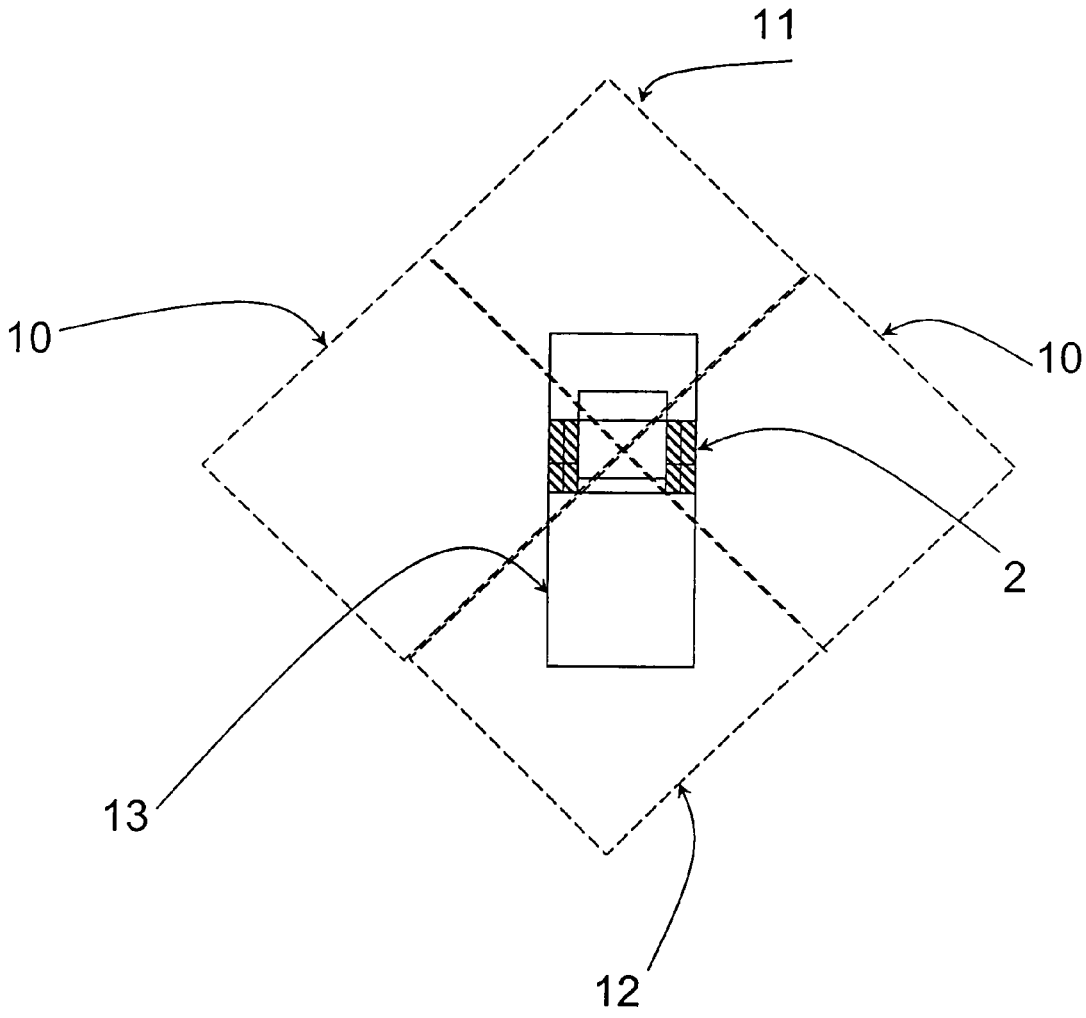
FIG. 4 shows an explanation of the different zones of fire the HSUUV is likely to encounter.

Description—FIG. 4

FIG. 4 depicts a top down view of the HSUUV with an explanation of the firing zones that the vehicle is likely to encounter. Zone A 10 is where the most fire is anticipated, and thus a huge amount of armor is concentrated. Zone B 11 is the front of the HSUUV, where minimal fire is anticipated and thus light armor is used. Zone C 12 is the back of the HSUUV where light fire is expected and thus light armor is used. Zone D 13 is the underside of the vehicle, which could be vulnerable to improvised explosive devices, thus under armor is installed there.

The Highly Survivable Urban Utility Vehicle provides a novel way to balance the concerns of armor, mobility and cost. All vehicles in this context have a maximum weight that they cannot exceed and remain useful. Prior art weights down the vehicle with light armor protecting the entire vehicle, distributing this maximum weight evenly. However, the HSUUV strongly protects only those areas that are most likely to be attacked, allowing those areas a level of protection never before possible.

Using the HSUUV, soldiers can safely and quickly enter areas that they otherwise would have had to fight and sustain casualties to enter. This will give US forces an unprecedented amount of flexibility, allowing for better strategic and tactical decisions.

While the above description contains many specificities, these should not be construed as limitations on the scope of the invention, but rather as an exemplification of one of the preferred embodiments. Many other variations are possible, including but not limited to, a HSUUV using a custom made, instead of commercial, vehicle, a HSUUV including an integrated weapons system, or a HSUUV designed to withstand other specific types of weapons.

What is claimed is:

1. A wheeled vehicle comprising:

truck mobility components configured to transport the weight of an armored crew compartment, cargo, and additional armor with a gross vehicle weight from 10,000 to 100,000 pounds;

said armored crew compartment constructed from armor material comprising a front, back and two lateral sides, configured with sufficient armor material to provide protection from explosive munitions fragments on said armored crew compartment front, back, top and bottom;

vehicle armor protection on the bottom of the vehicle configured and sufficient to protect against mines and improvised explosive devices (IEDs) in and near the road;

side armor located on said lateral sides comprising a mass configured to defeat explosive munitions including improvised explosive devices (IEDs) and armor piercing projectiles;

a thickness ratio greater than five of said side armor to either the front or back armor of the said armored crew compartment;

a weight ratio in pounds per square foot greater than three of said side armor to either the front or back armor of the said armored crew compartment;

said side armor with mass ranging from 60 to 250 pounds per square foot; and, said side armor with a thickness from 8 to 24 inches thick.

2. The wheeled vehicle of claim 1 built on a modular truck chassis with a modular armored crew compartment.

3. The wheeled vehicle of claim 1 where the crew enters the vehicle through doors in locations that are not part of the said side armor.

* * * * *